US008660475B2

(12) United States Patent
Lawton et al.

(10) Patent No.: US 8,660,475 B2
(45) Date of Patent: Feb. 25, 2014

(54) PRINTER MAINTENANCE BY APPLICATION OF A SERVICE PATCH

(75) Inventors: Robert J. Lawton, Meridian, ID (US); Brian Todd Bartlow, Nampa, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 194 days.

(21) Appl. No.: 13/307,735

(22) Filed: Nov. 30, 2011

(65) Prior Publication Data

US 2013/0136471 A1 May 30, 2013

(51) Int. Cl.
*G03G 21/00* (2006.01)

(52) U.S. Cl.
USPC ..... 399/346; 399/49; 399/71

(58) Field of Classification Search
USPC ..... 399/49, 71, 346
See application file for complete search history.

(56) References Cited

U.S. PATENT DOCUMENTS

| | | | | |
|---|---|---|---|---|
| 5,463,455 | A * | 10/1995 | Pozniakas et al. | 399/350 |
| 6,775,511 | B2 | 8/2004 | Kosuge | |
| 7,542,712 | B2 | 6/2009 | Tanaka et al. | |
| 8,103,206 | B2 * | 1/2012 | Gross et al. | 399/346 |
| 2002/0141798 | A1 * | 10/2002 | Jones et al. | 399/346 |
| 2003/0165757 | A1 * | 9/2003 | Kojima et al. | 430/56 |
| 2007/0116483 | A1 * | 5/2007 | Kobayashi et al. | 399/49 |
| 2008/0013978 | A1 * | 1/2008 | Facci et al. | 399/71 |
| 2008/0144067 | A1 | 6/2008 | Burry et al. | |
| 2009/0129793 | A1 * | 5/2009 | Milton et al. | 399/38 |
| 2010/0046976 | A1 * | 2/2010 | Gross et al. | 399/71 |
| 2010/0046997 | A1 | 2/2010 | Gross et al. | |
| 2010/0071077 | A1 | 3/2010 | Morris et al. | |
| 2010/0239284 | A1 | 9/2010 | Kondo | |
| 2011/0013959 | A1 * | 1/2011 | Thayer et al. | 399/346 |
| 2011/0318023 | A1 * | 12/2011 | Thayer et al. | 399/27 |

FOREIGN PATENT DOCUMENTS

JP 2005234358 A * 9/2005 ..... G03G 15/16

* cited by examiner

*Primary Examiner* — G. M. Hyder

(57) ABSTRACT

This disclosure relates to instructing deposition of a service patch for different toners, and determining the respective different toner amounts as a function of toner coverages on at least one previous media unit.

21 Claims, 7 Drawing Sheets

| Variable Tone Service Patch Example | | | | | | | | | |
|---|---|---|---|---|---|---|---|---|---|
| Image | Percent Coverage | | | | Service | Tone Level[1)] | | | |
| Page # | K | M | C | Y | Patch # | K | M | C | Y |
| P,1 | 2% | 0 | 0 | 0 | sp1 | 16% | 16% | 16% | 16% |
| P,2 | 16% | .8% | .2% | .9% | sp2 | 0% | 6% | 16% | 3% |
| P,3 | 1.5% | 1.0% | 1.2% | .8% | sp3 | 31% | 0% | 0% | 6% |
| n | 6% | 1.5% | 1.6% | 1.1% | spn | 0% | 0% | 16% | 3% |

| Variable Tone Service Patch, Option B Example | | | | | | | | | |
|---|---|---|---|---|---|---|---|---|---|
| Toner Area Coverages | | | | | Sub-Patch Toner Amounts | | | | |
| K | M | C | Y | K | M | C | Y |
| 0% | 0% | 0% | 0% | 50% | 16% | 16% | 16% |
| 16% | .8% | .2% | .9% | 0% | 6% | 16% | 3% |
| 1.5% | 1.0% | 1.2% | .8% | 31% | 0% | 0% | 6% |
| 0% | 0% | 0% | 0% | 50% | 16% | 16% | 16% |
| 16% | .8% | .2% | .9% | 0% | 6% | 16% | 3% |
| 1.5% | 1.0% | 1.2% | .8% | 31% | 0% | 0% | 6% |
| 0% | 0% | 0% | 0% | 50% | 16% | 16% | 16% |

PRINTER MAINTENANCE BY APPLICATION OF A SERVICE PATCH

BACKGROUND

Printer or toner cartridge parts may have longer and better functioning lives if maintained during their lifetimes. An example of a maintenance operation is lubrication. For example not all toner is transferred to a media. Residual toner may remain on a photoconductor drum or transfer belt, and may reach other cartridge elements, such as cleaner parts. Amongst others, the residual toner lubricates the cleaner parts and the drums so that wear is reduced. To prevent a reduced life of any of the involved printer elements some printers print a service patch in between jobs after 180 media units, after the job that is being done is finished. When the printer is still working on the same job after 200 media units it will need to temporarily interrupt the job to print the service patch for lubrication.

BRIEF DESCRIPTION OF THE DRAWINGS

For the purpose of illustration, certain examples of the present invention will now be described with reference to the accompanying drawings, in which.

DETAILED DESCRIPTION

In the following detailed description, reference is made to the accompanying drawings. The examples in the description and drawings should be considered illustrative and are not to be considered as limiting to the specific example or element described. Multiple examples may be derived from the following description and/or drawings through modification, combination or variation of certain elements. Furthermore, it may be understood that also examples or elements that are not literally disclosed may be derived from the description and drawings by a person skilled in the art.

Figure 1:
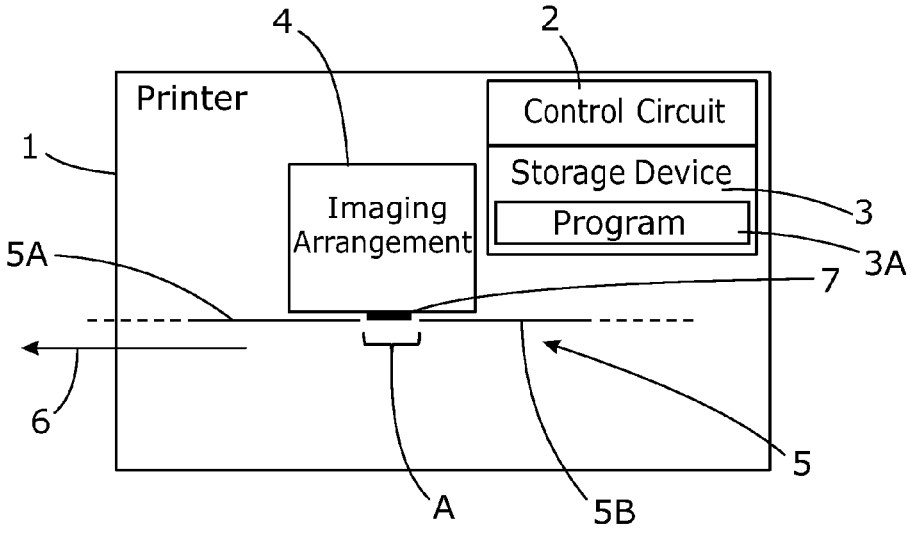
FIG. 1 shows a diagram of an example of a printer.

FIG. 1 shows a diagram of an example of a printer 1. The printer 1 may be an electrophotographic printer. The printer 1 includes a control circuit 2 and a digital storage device 3. The storage device 3 includes a computer program 3A that includes a set of instructions for execution by the control circuit 2. The printer 1 includes an imaging arrangement 4. The imaging arrangement 4 is arranged to deposit differently colored toners on media units 5A, 5B. To this end, the imaging arrangement 4 may include toner containers and transfer elements, for example embodied by replaceable toner cartridges, corresponding to the different colors such as cyan, magenta, yellow and black. The toner can include dry toner powder or toner liquid.

In use, the media units 5A, 5B are advanced in a direction 6, or in the opposite direction for example for duplex printing. A downstream media unit 5A represents an already printed media unit 5A, which may be referred to as previous media unit 5A. An upstream media unit 5B represents a media unit 5B that is delivered for printing. In the shown example, an area A extends between the subsequent media units 5A, 5B. The size of the area A may be determined by the distance between subsequent media units 5A, 5B. This is a diagrammatic example in the sense that the area A may extend on a photoconductor drum or transfer belt and represents any area of any toner transfer element that does not transfer toner to the respective media unit 5A, 5B because any toner in the area A would land between the subsequent media units 5A, 5B.

In an example, the control circuit 2 is configured to calculate toner coverages of different toners that are printed on a media unit 5A. For example, the toner coverage may be a mass per unit area, such as for example grams of toner per square millimeter. For example, the control circuit 2 calculates and determines a toner mass per unit area to be deposited on the media unit 5A. In another example, toner coverages may be indicated in a percentage of an area. For example, a pixel or dot can have a percentage coverage between 0 and 100% for a primary color, for example Cyan (C), Magenta (M), Yellow (Y) or Black (K). For example, a percentage of a secondary color could be up to 200%, for example 100% Y and 100% M. Depending on the print system, a pixel or dot may for example have up to approximately 220% coverage. Other example print systems may have other percentage coverage characteristics. In again other examples, the coverages of the toners on the media unit 5A may be in absolute area coverages. In another example, the toner coverage may be indicated in weight per unit area, such as for example grams per square millimeter In an example, the control circuit 2 is configured to instruct the imaging arrangement 4 to deposit a service patch 7. The service patch 7 is deposited so that it is not transferred to the media units 5A, 5B. For example, the service patch 7 is deposited in the area A, so that the toner may service any of the printer components without affecting a printed media unit 5A. For example, the service patch 7 is configured to lubricate one or more cleaning devices and/or other printer components to extend a lifetime of the imaging arrangement 4. In an example, the amounts of the deposited toners within the service patch 7 are determined as a function of the calculated total coverage of one toner on at least one previous media unit 5A.

For example, the service patch toner amounts are inversely related to the calculated respective toner coverages as printed on one or more previous media units 5A. For example, service patch toner amounts may compensate for non-print rotations of one or more drums of an imaging arrangement 4. In an example, the service patch 7 may be printed to service a respective part. In an example, the service patch 7 may prevent wear of a respective part. In an example, the toner coverage may be determined per number of non-print rotations of one or more image arrangement drums, such as for example a photoconductor drum, since a previous calculation. In an example, a relatively low toner coverage of at least one previous print may correspond to a relatively high toner amount in the service patch 7, and vice versa.

In one example, a service patch 7 is deposited after each printed media unit 5A, or after each small series of previous media units 5A, for example two, three, four, five or more media units 5A. A continuous, dynamic maintenance of the printer 1 may be achieved by continuously depositing service patches 7 after each printed media unit 5A or after each small number of previous media units 5A, without a need to interrupt a print job, wherein within the service patch 7 the toner amounts are varied according to the measured toner coverages of the at least one previous printed media unit 5A. The color amounts such as for example cyan, magenta, yellow and black in the service patches 7 may be varied according to the corresponding calculated coverages on the printed media.

Figure 2:
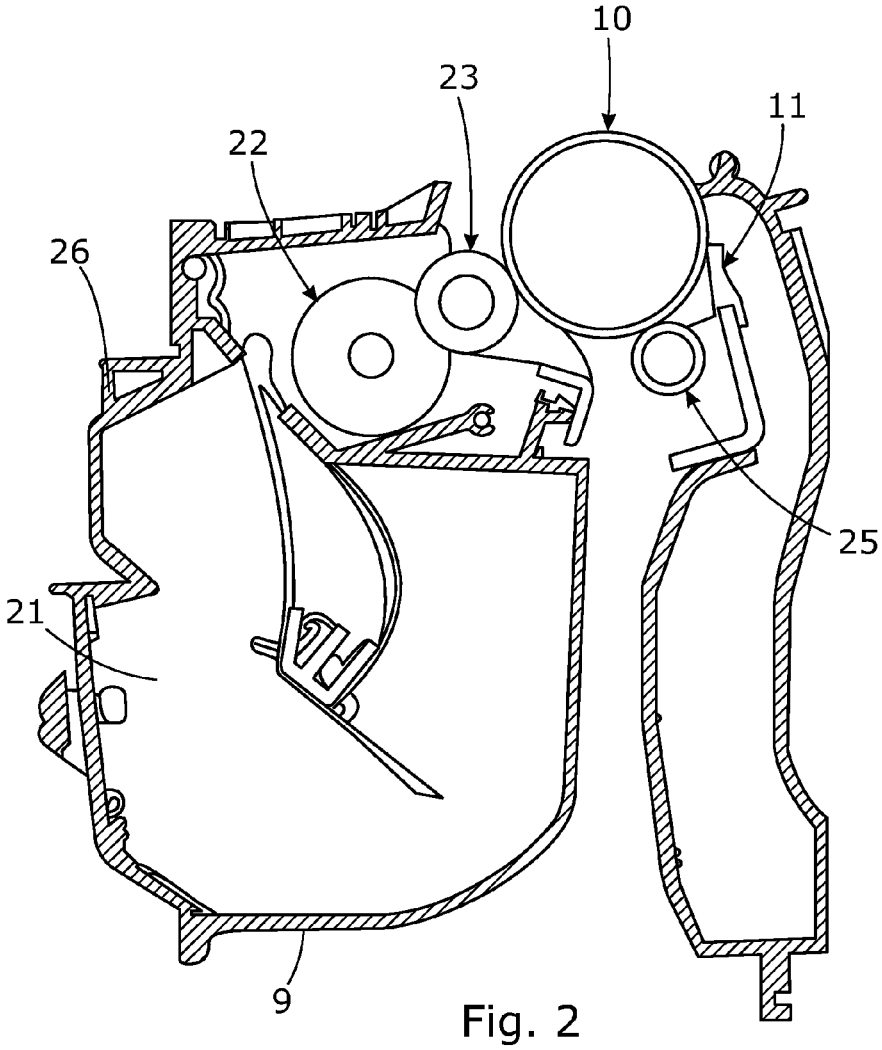
FIG. 2 shows a cross sectional side view of an example of a toner cartridge.

FIG. 2 shows an example of a toner cartridge 9 in cross section that is part of the imaging arrangement 4. The cartridge 9 is provided with a photoconductor drum 10. The toner cartridge 9 includes a powdered toner supply 21 and a toner feed drum 22 for feeding the toner. The cartridge 9 includes a developer drum 23 for developing the toner and transferring toner to the photoconductor drum 10. The cartridge 9 includes a photoconductor drum cleaning device 11 for cleaning the surface of the photoconductor drum 10 from residual toner. The shown example cleaning device 11 includes a cleaning blade. The cartridge 9 includes a waste hopper 24 for storing the residual toner. Furthermore, the toner cartridges 9 include a charger drum 25. The photoconductor 10, toner feed drum 22, developer drum 23 and charger drum 25 may be referred to as imaging drums. In other examples, more or other imaging drums may be provided within the imaging arrangement. The cartridge 9 includes a housing 26. In one example, the shown cartridge 9 is a user or operator replaceable cartridge 9 that is arranged to be replaced when the toner in the supply 21 is exhausted. In another example, the shown cartridge 9 is arranged to be fixed in the printer 1, or to be replaced by authorized parties only so as to be replaced or refilled together with the entire printer 1 from an end user perspective.

Figure 3:
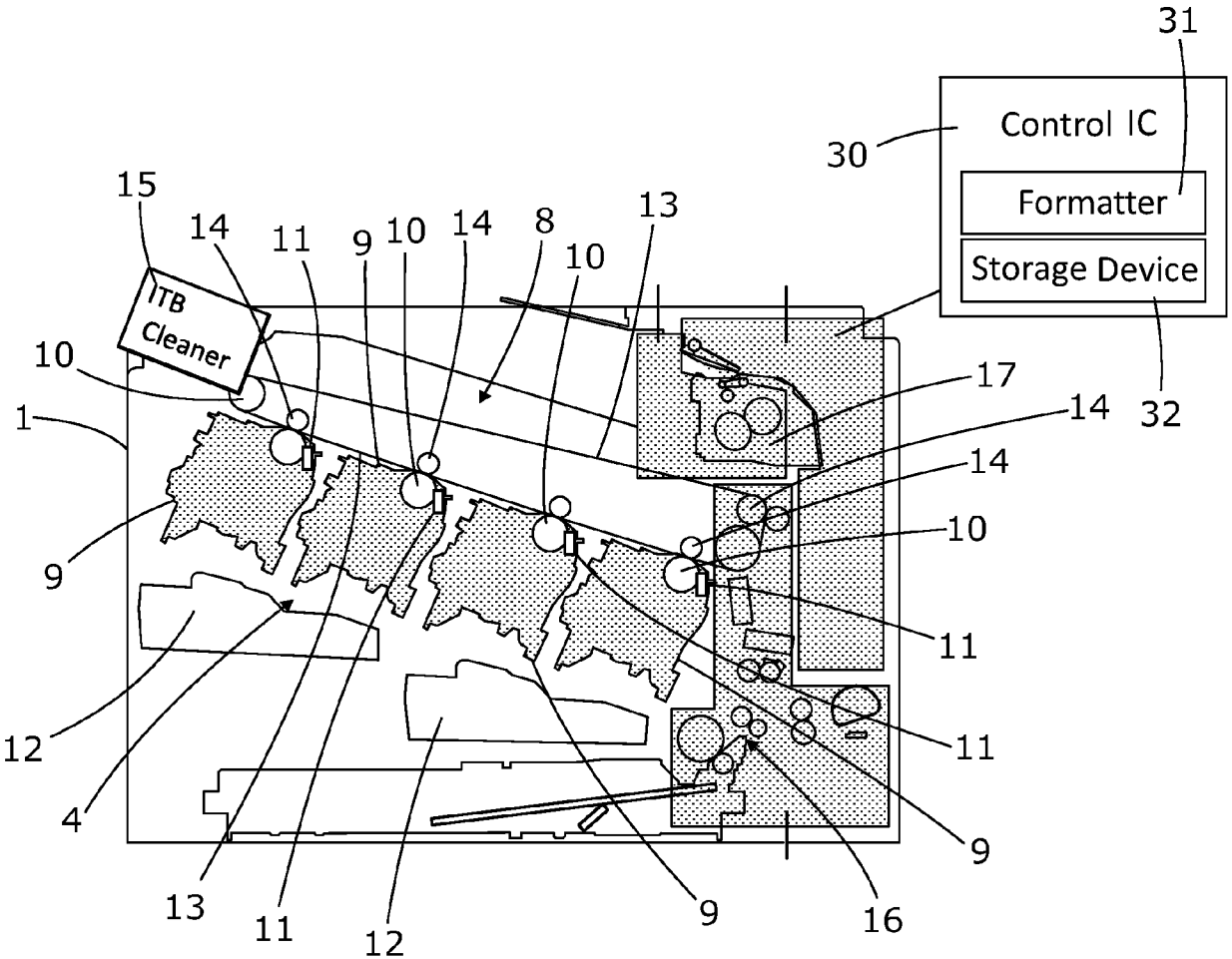
FIG. 3 shows a cross sectional side view of another example of a printer.

FIG. 3 shows a cross sectional view an example of an electrophotographic printer 1. The printer 1 includes an imaging arrangement 4 and a transfer arrangement 8. In the shown example, the imaging arrangement 4 includes four pre-installed replaceable toner cartridges 9, corresponding to the colors cyan, magenta, yellow and black. In another example (not shown), the imaging arrangement 4 includes toner containers that are locked within the printer 1 configured to remain in the printer during a lifetime of the printer 1 at an end user's location, for example until it is refilled, replaced or recycled by a manufacturer or reseller.

The printer 1 may include a cartridge mounting apparatus for mounting the cartridges 9 in the printer 1. The imaging arrangement 4 includes an irradiation arrangement 12 for irradiating the photoconductor drum 10 for latent image formation on the photoconductor drum 10. The irradiation arrangement 12 may include laser devices for irradiating the respective photoconductor drums 10.

The example transfer arrangement 8 includes a transfer belt 13 and transfer rollers 14. The printer 1 includes a transfer belt cleaning device 15 for cleaning residual toner that is left on the transfer belt 13 after printing. The printer 1 includes a media advance system 16 and a fuser assembly 17 for fusing the toner to the media units 5A, 5B.

The example printer 1 includes a control circuit 30. The control circuit 30 may include an integrated circuit such as a digital and analogue integrated circuit for driving the printer components, including the imaging arrangement 4 and the transfer arrangement 8. The control circuit 30 may include a formatter 31 and a storage device 32. The integrated circuit 30 may include firmware or software such as a computer program comprising a set of instructions for execution by the control circuit 30.

For example, the control circuit 30 is configured to instruct the imaging arrangement 4 to feed the service patch 7 to a surface of the respective photoconductor drum 10 that corresponds to the area A between the media units 5A, 5B (FIG. 1). Depending on the printed content of the at least one previous media unit 5A, a service patch 7 may be printed on each photoconductor drum 10. The service patches 7 may be cleaned by the respective photoconductor drum cleaning devices 11.

Note that, although multiple services patches 7 are fed to the photoconductor drum 10, in this description these may be referred to as a single service patch 7, corresponding to the single (for example multi-color) service patch 7 instructed by the control circuit 30. The imaging arrangement may be instructed to print a multi-colored or halftone pattern service patch 7 in the area A, resulting in multiple service patches 7 on the each of the different photoconductor drums 10.

In one example, the control circuit 30 is configured to adjust a respective photoconductor bias or a transfer belt bias to direct service patch toner portions towards one of the photoconductor cleaning device 11 and the second cleaning device 15. For example, by temporarily adjusting the photoconductor or transfer belt voltage the service patch toner corresponding to the area A between the media units 5A, 5B (FIG. 1) may be retained to photoconductor drum 10, without being transferred to the transfer belt 13. This retained service patch toner will reach the photoconductor drum cleaning device 11, for example for lubricating a respective cleaning blade. In another example, the bias can be temporarily adjusted for transfer of a substantial portion of the service patch 7 to the transfer belt 13, so that less or no toner is left behind on the photoconductor drum 10. In such example, service patch toner could be transferred to the second cleaning device 15 and/or other printer components.

In a further example, the printer 1 includes a drive system that is arranged to alienate the color toner cartridges 9, for example for printing a monochrome print job. In such printer 1 the control circuit 30 may be configured to instruct the imaging arrangement 4 to not print colored service patches 7 during said alienation.

Figures 4, 5:
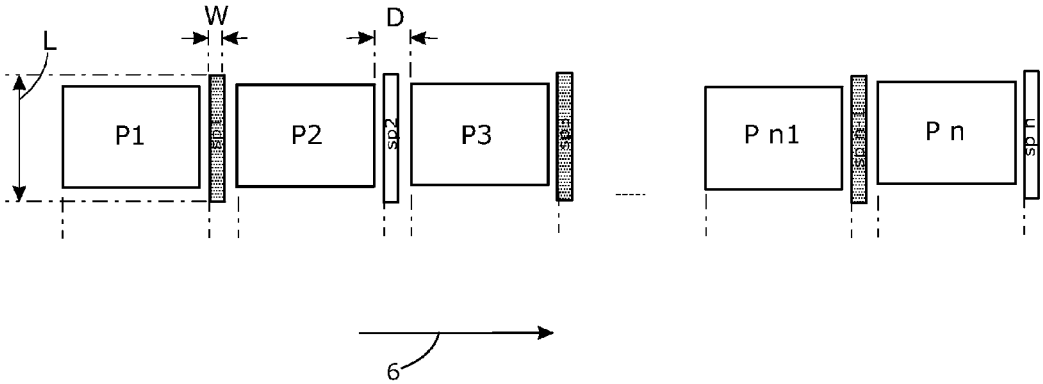
FIG. 4 shows a diagrammatic illustration of an example of subsequent media units and service patches.
FIG. 5 shows an example of a table plotting toner coverages of a previous media unit versus calculated corresponding service patch toner amounts.

FIG. 4 shows an example diagram of subsequent "previous" media units P1-Pn that run through the printer, and corresponding instructed service patches sp1-spn that are deposited after each media unit P1-Pn. FIG. 5 shows an example of a corresponding table with for each media unit P1-Pn the calculated average toner percent coverage of the respective color on the respective media unit P1-Pn, and the corresponding average percent coverages the service patch sp1-spn. Herein, a percentage coverage may be an average toner coverage per pixel or dot.

In an example, after each print, the service patch 7 has standard outer dimensions within which the toner amounts are adjusted. For example, the service patch 7 may have a predetermined rectangle shape. The control circuit 2, 30 may be arranged to instruct the imaging arrangement 4 to deposit the service patch 7 according to these standard dimensions. For example, the toner coverage of each service patch 7 is adjusted, while the outer dimensions remain the same. For example, the service patch sp1-spn may have a length L that approximately corresponds to a photoconductor length and/or to a width or length of a US Letter or A4 or A3 standard, the length direction of the service patch 7 sp1-spn being perpendicular to the media advance direction 6. For example, the service patch sp1-spn may have a width that is smaller than a pitch D between subsequent media units P1, P2, for example of approximately 4 centimeters or less, the width being measure in the media advance direction 6. In an example, the service patch 7 has a width of approximately 8 millimeters and a length of approximately 240 millimeters, or for example a width of approximately 8 millimeters and a length of approximately 305 millimeters. In other examples a width of the service patch 7 may vary between approximately 2 millimeters and approximately 15 millimeters, and a length of the service patch 7 may for example vary between approximately 150 and approximately 400 millimeters.

In the example table of FIG. 5 the toner amounts of the service patch sp1-spn are inversely related to the corresponding toner coverages of the previous media unit. For example, a first media unit P1 had 2% of coverage of black only. In an example, this implies no residual toner resides on the magenta, cyan and yellow photoconductor drums 10 and relatively little residual toner on the black photoconductor drum 10. This may increase friction of the corresponding drums or cleaning devices 11, which could increase wear or decrease total cartridge life, which in turn may be compensated by the service patch sp1. For example the service patch sp1 includes a service patch sp1 with a coverage of 16% for each color K, M, C, and Y. For an example a third measured media unit P3 has a relatively low area coverage of black (1.5%), a relatively high coverages for magenta and cyan (1.0% and 1.2%, respectively) and a slightly lower coverage for yellow (0.8%). Correspondingly, a higher coverage of black toner (31%) is added to the service patch sp3, no magenta and cyan toner (0%) is added to the service patch sp3, while a relatively low coverage of yellow toner (6%) is added to the service patch sp3.

In an example, the control circuit 2, 30 uses a Look-Up Table that couples previous page's toner coverages to service patch toner amounts to retrieve the service patch toner amounts after having calculated the toner coverages of the at least one previous media unit 5A. Alternatively, an algorithm to compute coverage could reside in firmware of the printer 1. For example, for black a different algorithm for the coverage and the service patch toner amount can be used, than for other colors. In other examples, the function between the calculated toner coverages and the service patch toner amounts may be different for one or for each photoconductor drum 10, cartridge 9, cartridge color, age of the cartridge, cartridge usage history, etc.

Figure 6:
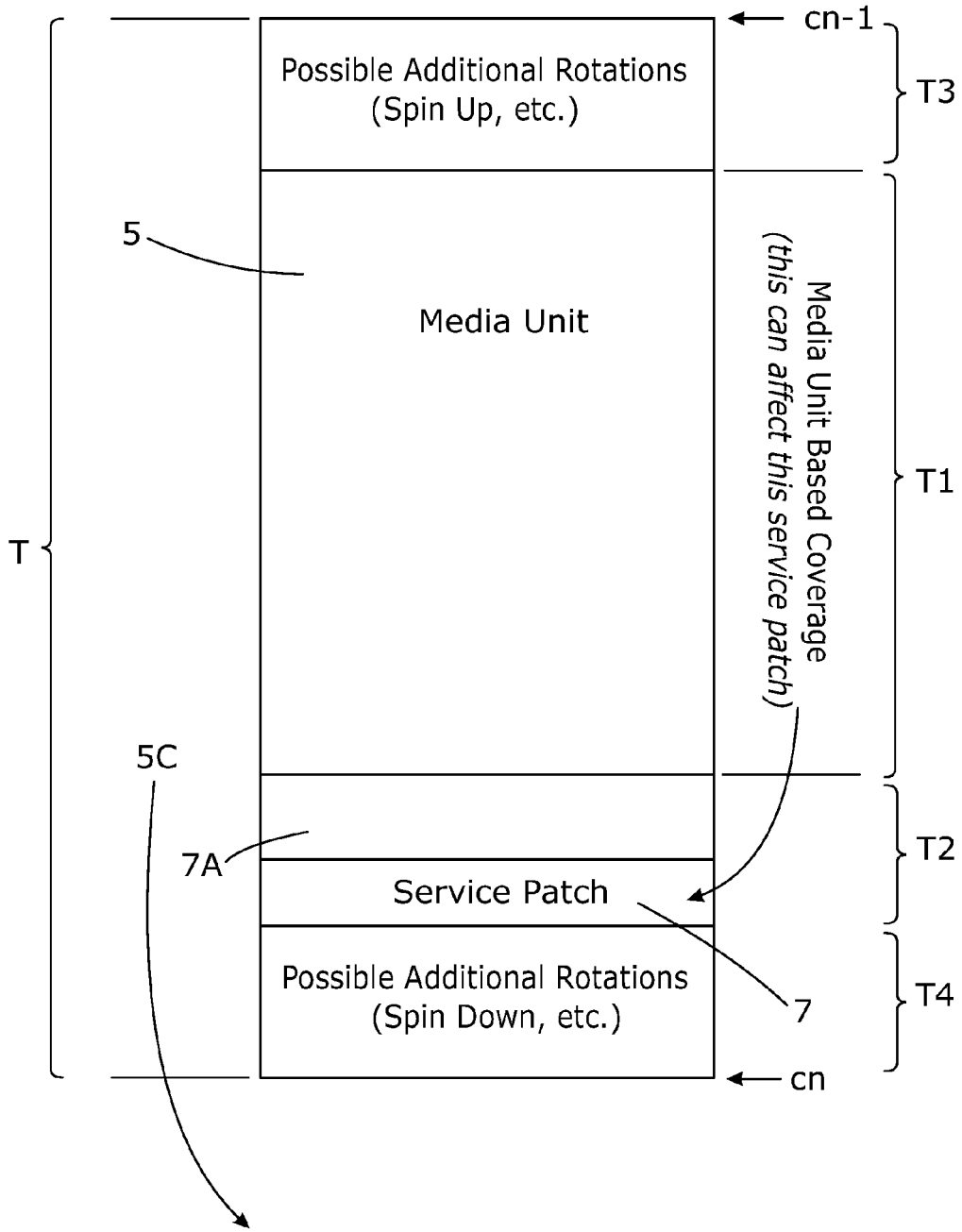
FIG. 6 shows a diagrammatic illustration of examples of subsequent coverages that correspond to photoconductor rotations.

In an example, the toner densities in the service patch 7 are a function of the measured toner coverages and imaging drum rotations, as illustrated by FIG. 6. An imaging drum may be any of the photoconductor drum 10, toner feed drum 22, developer drum 23 or charge drum 25 (see also FIG. 2, or FIG. 3). In one example the calculated toner coverages for determining the service patch toner amounts are based on a rotation amount of the respective imaging drum 10, 22, 23, 25 between two subsequent points of calculation cn, cn-1. FIG. 6 shows a total interval T between the two points of calculation cn, cn-1. For example, the total photoconductor drum rotation amount corresponds to the amount of rotations for printing the media 5, the service patch 7, and for example additional rotations between, before and after printing the media 5 and the service patch 7.

As shown in the example of FIG. 6, a predetermined service interval T between two points of calculations cn, cn-1 may include (i) a first interval T1 corresponding to a first rotation amount for printing on the media unit 5A, 5B, P1-Pn, (ii) a second interval T2 corresponding to a second rotation amount for printing the service patch 7 and for rotating over an area 7A between printing the media unit 5 the service patch 7. The predetermined service interval T may furthermore include at least one of (iii) a third interval T3 corresponding to a third rotation amount before starting to print, for example corresponding to a spinning up of the photoconductor drum 10, and (iv) a fourth interval T4 corresponding to a fourth rotation amount after printing the service patch 7, for example corresponding to a spinning down of the photoconductor drum 10. In this example, the total rotation amount between calculations cn, cn-1 may be the accumulated first, second, third and fourth rotation amounts of a respective imaging drum. For example, the calculated total rotation amount is used to determine the toner amounts for a service patch 7 of a next print 5C.

In an example, the control circuit 2, 30 is configured to calculate the service patch toner amounts as a function of the photoconductor drum rotation amount between subsequent calculations cn, cn-1, for example since the previous calculation. In other examples the service patch toner amount may be calculated as a function of any of the other cartridge drums 22, 23, 25, and in again other examples it does not matter which exact drum rotation is measured as long as a correct constant K is used. For example, the toner densities in the service patch 7 are a function of the respective drum rotation amount for the previous interval T divided by the corresponding toner coverages in the previous interval T. In an example, the control circuit 2, 30 may be configured to include the toner coverages of the previous service patch 7 when calculating the total toner coverages and corresponding service patch toner amounts.

Figure 7:
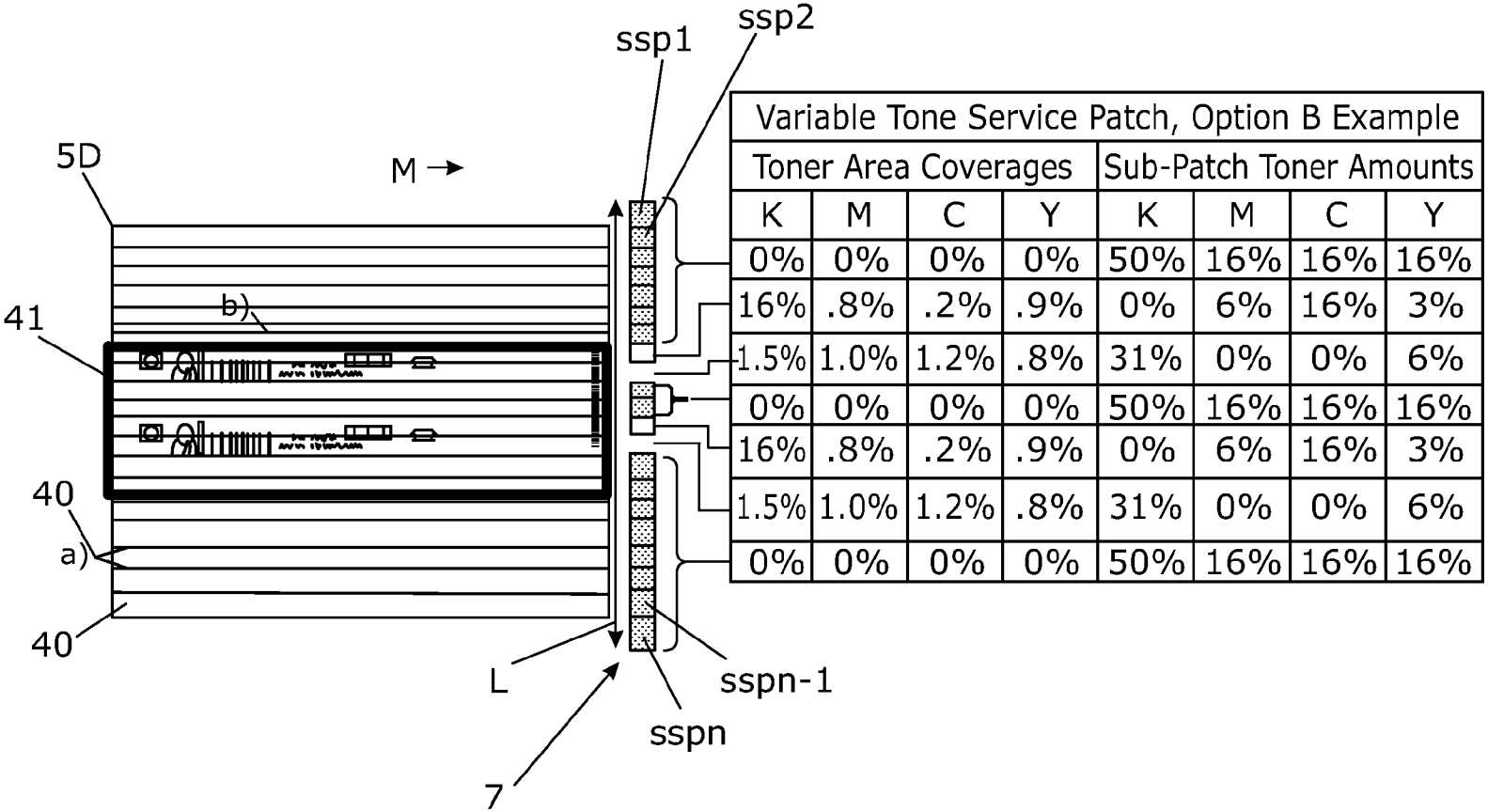
FIG. 7 shows an example of a media unit with longitudinal strip shaped sections, and a table with corresponding toner sub-coverages and calculated corresponding sub-service patch toner amounts.

FIG. 7 shows a media unit 5D that includes a printed image 41. In the shown example, the control circuit 2, 30 divides the media unit 5 into multiple longitudinal strip shaped sections 40. In the shown example, the longitudinal strip shaped sections 40 have a length-direction that is parallel to the media advance direction M. For example, the longitudinal strip shaped sections 40 may be one or several microns, millimeters, centimeters, pixels or dots wide. The longitudinal sections 40 may be arranged parallel to a width of the media unit, for example in a "long edge leading" orientation of the media, or parallel to a length direction of the media unit, also known as a "short edge leading" orientation. In an example the control circuit 2, 30 is configured to calculate toner sub-coverages of the toners on respective longitudinal strip shaped sections 40 of the at least one previous media unit 5D.

The shown example service patch 7 comprises sub-patches ssp1-sspn. The sub-patches ssp1-sspn are arranged along a width of a media unit 5D, which in this example has a short edge leading orientation. The length L of the full service patch 7 may correspond to the toner transferring portion of the photoconductor drum 10, or for example be as long as a long edge of the largest printable media that can be printed with the example printer 1 in a long edge leading orientation. In the shown example, each sub-patch ssp1-sspn is arranged near an end of a corresponding longitudinal strip shaped section 40. In other examples, one sub-patch ssp1-sspn may correspond to multiple longitudinal strip shaped sections 40 and vice versa.

The control circuit 2, 30 is configured to determine the toner amounts in each of the sub-patches ssp1-sspn as a function of the corresponding toner sub-coverages in the respective longitudinal strip shaped sections 40. This may result in adapted lubrication of portions of the cleaning device (s) 11 or 15 or imaging drums 10, 22, 23, 25 that correspond to the longitudinal strip shaped sections 40.

The table of FIG. 7 relates the measured toner coverages of the respective longitudinal strip shaped sections 40 to the to-be-deposited toner amounts of the sub-patches ssp1-sspn.

As can be seen, the top longitudinal sections 40 of the media unit 5D are unprinted, which corresponds to 0% coverage and relatively high coverage amounts for all the colors (50%, 16%, 16%, 16%) in the top sub-patches ssp1, ssp2, so as to compensate for lack of lubrication during the normal print. Another row of the table of FIG. 7 corresponds to the top longitudinal strip shaped section 40 that overlaps the top of the image 41. The measured toner coverages in that longitudinal strip shaped section 40 are 16%, 0.8%, 0.2% and 0.9%, leading to calculated corresponding sub-patch toner amounts of 0%, 6%, 16% and 3% for K, M, C and Y, respectively. In the shown example table of FIG. 7, the service patch toner amounts are inversely related to the measured toner coverages.

Figure 8:
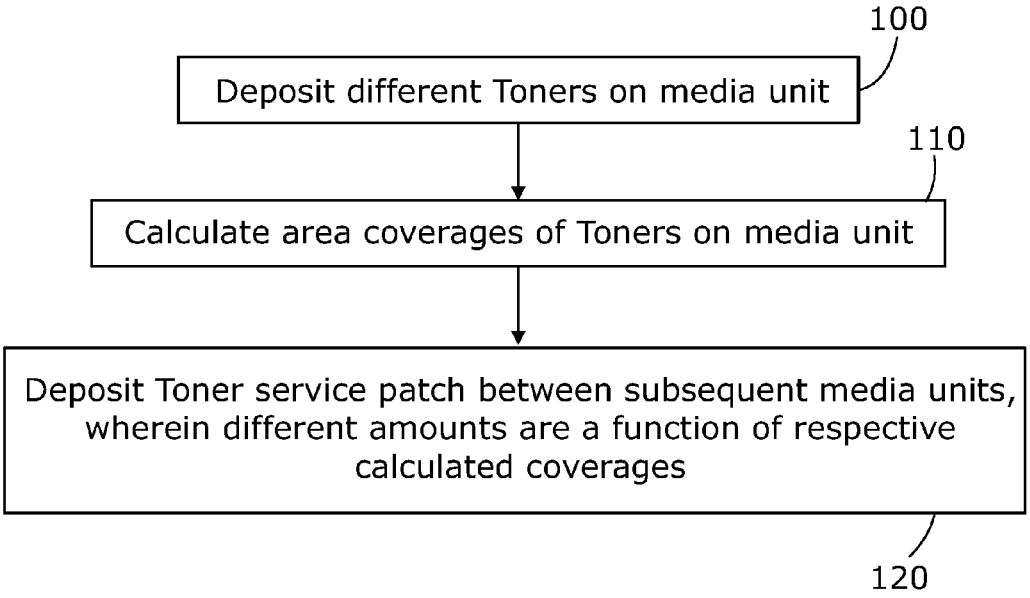
FIG. 8 shows a flow chart of an example of a printer maintenance method.

FIG. 8 shows a flow chart of an example of a printer maintenance method. In an example, the printer maintenance method includes depositing different toners onto a media unit 5, 5A, P1-Pn (block 100), for example differently colored toners. In an example, the printer maintenance method includes calculating toner coverages of the respective toners on the media unit 5, 5A, P1-Pn (block 110). In an example, the printer maintenance method includes depositing a service patch 7, sp1-spn with different toners between subsequent media units 5, 5A-D, P1-Pn wherein the respective toner amounts of the service patch 7, sp1-spn are determined as a function of the corresponding toner coverages of at least one previous media unit 5, 5A, 5D, P1-Pn (block 120).

Figure 9:
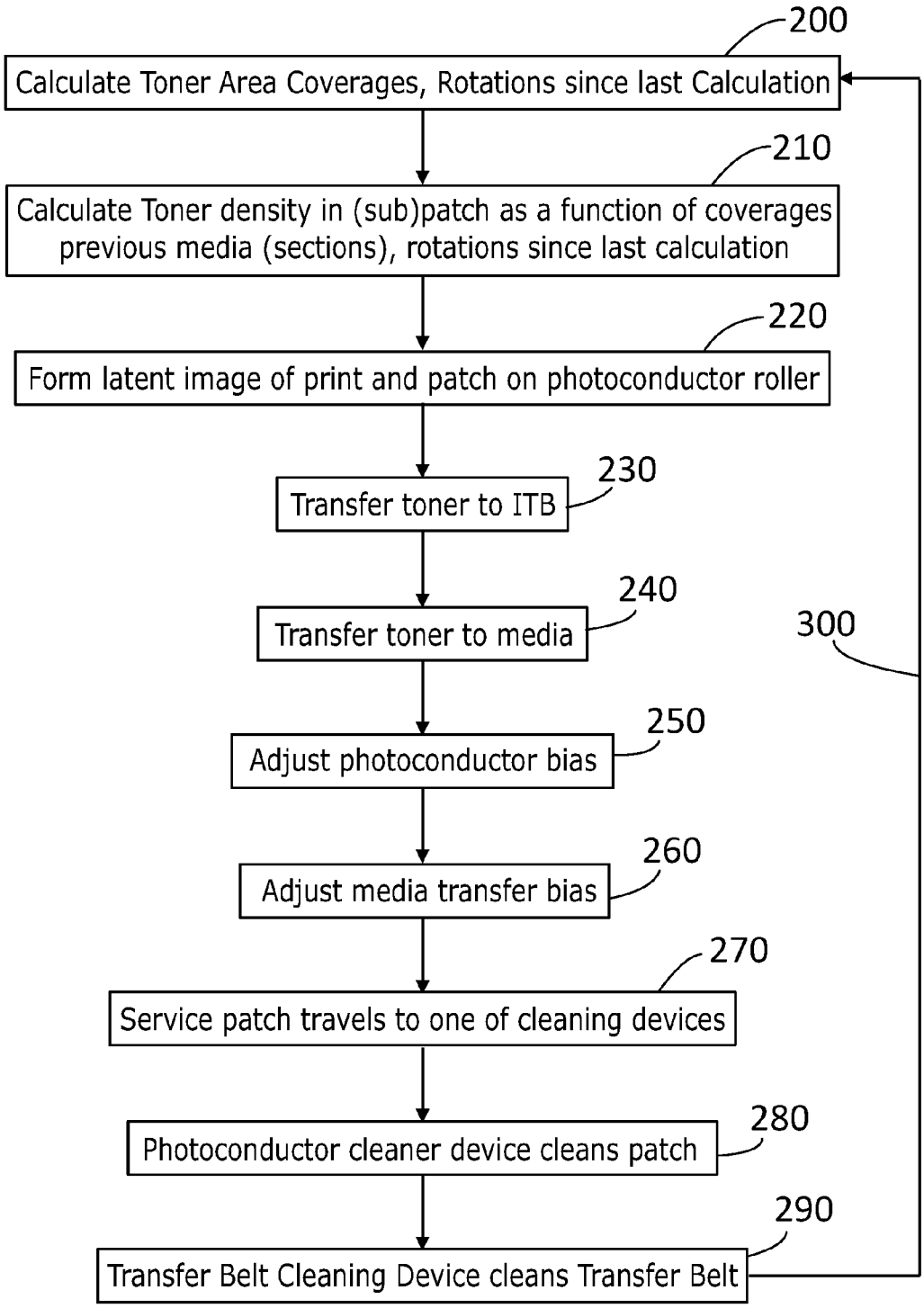
FIG. 9 shows a flow chart of another example of a printer maintenance method.

FIG. 9 shows a flow chart of another example of a printer maintenance method. For example, toner coverages of the respective toners deposited on at least one previous media unit 5, 5A, 5D, P1-Pn are calculated (block 200). In a further example, toner coverages of longitudinal strip shaped sections 40 of the at least one previous media unit 5, 5A, 5D, P1-Pn are determined. Also a total imaging drum rotation amount since a previous calculation may be determined.

For example, the different toner densities in the service patch 7, or sub-patches ssp1-sspn, are calculated (block 210). The densities are determined as a function of the corresponding toner coverages on the at least one previous media unit 5, 5A, 5D, P1-Pn, or on the respective longitudinal strip shaped sections 40 in case of sub-patches ssp1-sspn. Furthermore, the respective service patch or sub-patch toner densities may be determined as a function of the determined imaging drum rotation amount since the previous calculation, or between two subsequent previous calculations.

In one example a service patch configuration may be determined by:

> service patch toner density=$K$−(area of media unit/toner mass), wherein $K$ is a constant such as for example 2.5%. In an example, a maximum density of service patch toner may be applied, for example 16%.

In another example, the service patch configuration may be determined by:

> toner density=$K$*(photoconductor rotations since previous calculation/toner coverage), wherein $K$ is a constant.

In again other examples, another algorithm may be used, for example that combines these two principles.

A latent image of the print image 41, or an inverse latent image of the print image, is formed on one or more photoconductor drums 10 (block 220) by the irradiation arrangement 12. Also a latent image of the service patch 7, or an inverse latent image of the service patch 7, is formed on one or more of the photoconductor drums 10 by the irradiation arrangement 12, after the latent image of the print image 41. The toner is fed to the photoconductor drum 10 by the feed drum 22, placing the image 41 and afterwards the service patch 7 on the photoconductor drum surface. While the photoconductor drum 10 rotates, the toner for the print image 41 is transferred to the transfer belt 13 (block 230). The image 41 is transferred to the respective media unit 5, 5A, 5B, P1-Pn by the transfer belt 13 (block 240).

In one example, the photoconductor drum bias is temporarily adjusted when the service patch 7 on the photoconductor drum 10 reaches the transfer belt 13 (block 250). For example, the photoconductor drum bias is adjusted so that the service patch toner is not transferred the transfer belt 13, but rather, reaches the photoconductor cleaning device 11, or, the photoconductor drum bias may be adjusted so that the service patch toner is better transferred the transfer belt 13. In a further example, the transfer belt bias is adjusted (block 260). For example, the transfer belt bias is adjusted to prevent service patch transfer to the transfer belt 13, or the transfer belt bias is adjusted so that most or all of the service patch toner is transferred the transfer belt 13 and for example reaches the transfer belt cleaning device 15. At subsequent service patches 7 or within the same service patch 7, and for each individual color, the respective transfer belt and imaging drum biases may be adjusted so that certain service patch toner amounts reach both cleaning devices 11, 15. Also both the transfer belt and imaging drum biases may be adjusted at the same time to regulate service patch transfer. The service patch toner may travel with either the transfer belt 13 or the photoconductor drum 10 to the respective cleaning device 15, 11 (block 270).

In one example, the photoconductor cleaner 11 cleans the service patch 7 or a portion thereof from the photoconductor drum 10 (block 280). In another example, the transfer belt cleaning device 15 cleans service patch 7 or a portion thereof from the transfer belt 13 (block 290). Also other printer or cartridge parts may be serviced by the service patches 7 printed by each of the single color cartridges.

As indicated with looping arrow 300, the calculations of the respective toner coverages and the printing of the service patches 7 may be continuously repeated after each media unit 5A. A service patch 7 may be printed before or after each print or series of prints, and each time for each color cartridge with rotating drums. Depending on the embodiment, a multi-color service patch 7 may be transferred to the transfer arrangement 8, or single-color service patches 7 may be transferred within each of the single color cartridges 9. The cartridges 9 may each be exchangeable, or may be arranged as sub-imaging arrangements 4 fixed within the printer 1. The mentioned blocks of the example of FIG. 9 do not need to be in the order as described, and some features or blocks may be left out, depending on the application. For example, the bias does not need to be adjusted, or the number of rotations is not taken into account for printing the service patch 7. In other examples transfer arrangements 8 other than a single transfer belt may be used.

In a further aspect of this disclosure, a computer program 3A is provided, in an example intended for maintenance of an imaging arrangement 4 in a printer 1, the program 3A including a code that is configured to instruct an imaging arrangement 4 to deposit a service patch 7 of different toners between subsequent media units 5A, 5B, P1-Pn, and determine the respective toner amounts as a function of pre-calculated toner coverages of at least one previous media unit In one example, each colored service patch 7 may be instructed as one single multi-color service patch 7. In another example, each colored cartridge 9 may at a slightly different location between the media as if printing multiple differently colored service patches 7 between subsequent media units 5.

The above description is not intended to be exhaustive or to limit this disclosure to the examples disclosed. Other variations to the disclosed examples can be understood and effected by those skilled in the art from a study of the drawings, the disclosure, and the claims. The indefinite article "a" or "an" does not exclude a plurality, while a reference to a certain number of elements does not exclude the possibility of having more or less elements. A single unit may fulfil the functions of several items recited in the disclosure, and vice versa several items may fulfil the function of one unit. Multiple alternatives, equivalents, variations and combinations may be made without departing from the scope of this disclosure.

What is claimed is:

1. A printer, comprising:

an imaging arrangement, a digital storage device, and a control circuit, configured to:

calculate toner coverages of different toners deposited on a previous media unit, and instruct the imaging arrangement to deposit a service patch comprising an amount of toner of different toners between subsequent media units, wherein the amounts of toner are determined as a function of the corresponding toner coverages of at least one previous media unit;

in which the control circuit:

calculates toner sub-coverages on respective longitudinal strip shaped sections of the media unit, the longitudinal strip shaped sections have a length-direction that is parallel to the media advance direction, and deposits the service patch so as to comprise sub-patches at least a part of the sub-patches being arranged near corresponding ends of the longitudinal strip shaped sections, in which toner amounts of the sub-patches are determined as a function of the corresponding toner sub-coverages in the respective longitudinal strip shaped sections.

2. The printer of claim 1, wherein the toner amounts are inversely related to the corresponding toner coverages of the at least one previous media unit.

3. The printer of claim 1, wherein the control circuit is configured to determine a total imaging drum rotation amount between subsequent calculations, and to calculate the service patch toner amounts as a function of the total imaging drum rotation amount.

4. The printer of claim 1, wherein the imaging arrangement comprises a transfer arrangement for transferring the toner from a photoconductor drums to a media unit, and the control circuit is configured to instruct the imaging arrangement to deposit the service patch along the length of a corresponding photoconductor drum portion that is used for transfer of the toner, and vary the coverage of each toner in the service patch as a function of the determined toner coverages of the at least one previous media unit.

5. The printer of claim 4, wherein the control circuit is configured to adjust an imaging arrangement bias to direct service patch toner portions towards one of a photoconductor cleaning device and a transfer belt cleaning device.

6. The printer of claim 1, in which the service patch has a width of 4 centimeters or less.

7. A printer maintenance method, comprising depositing different toners onto a media unit, calculating toner coverages of the respective toners on the media unit, and depositing a service patch of different toners between subsequent media units of which the respective toner amounts are determined as a function of the corresponding toner coverages of at least one previous media unit.

in which service patch toner amounts are varied by varying respective densities within the service patch, the service patch comprising different colors of toners of different respective densities.

8. The printer maintenance method of claim 7, wherein the respective service patch toner amounts are inversely related to the corresponding toner coverages of the at least one previous media unit.

9. The printer maintenance method of claim 8, comprising determining a total imaging drum rotation amount between subsequent calculations, calculating the service patch toner amounts as a function of the total imaging drum rotation amount.

10. The printer maintenance method of claim 7, wherein different service patches have approximately the same predefined surface dimensions.

11. The printer maintenance method of claim 10, wherein the patch spans a length of a portion of the photoconductor drum that is used for transfer of the toner.

12. The printer maintenance method of claim 7, comprising adjusting a bias to direct portions of the service patch toner towards one of a photoconductor cleaning device and a transfer belt cleaning device.

13. The printer maintenance method of claim 7, comprising calculating toner sub-coverages of the toners on respective longitudinal strip shaped sections of the media unit, the longitudinal strip shaped sections have a length-direction that is parallel to the media advance direction, the service patch comprising sub-patches that are arranged along the width of the media unit, each sub-patch being arranged near an end of the corresponding longitudinal strip shaped section, wherein toner amounts of the sub-patches are inversely related to the corresponding toner sub-coverages of the respective longitudinal strip shaped sections.

14. The printer maintenance method of claim 7, comprising a first portion of the toner of the service patch reaching a photoconductor cleaning device and a second portion of the toner of the service patch reaching a transfer arrangement cleaning device.

15. The printer maintenance method of claim 7, in which depositing a service patch of different toners between subsequent media units comprises applying a service patch having a width of 4 centimeters or less.

16. The printer maintenance method of claim 7, in which the densities are pre-calculated toner coverages that are referenced using a look-up table.

17. The printer maintenance method of claim 7, in which the densities are a function of the measured toner coverages and the rotation of an imaging drum.

18. Computer program for maintenance of an imaging arrangement in a printer, comprising a code that is configured to:

instruct an imaging arrangement to deposit a service patch of different toners in an area between subsequent media units, and determine the respective toner amounts as a function of pre-calculated toner coverages of at least one previous media unit; and instruct an imaging arrangement to vary densities of toner within the service patch.

19. The computer program of claim 18, in which depositing a service patch of different toners between subsequent media units comprises applying a service patch having a width of 4 centimeters or less.

20. The computer program of claim 18, in which densities are pre-calculated toner coverages that are referenced using a look-up table.

21. The computer program of claim 18, in which the densities are a function of the measured toner coverages and the rotation of an imaging drum.

* * * * *

UNITED STATES PATENT AND TRADEMARK OFFICE

CERTIFICATE OF CORRECTION

PATENT NO. : 8,660,475 B2
APPLICATION NO. : 13/307735
DATED : February 25, 2014
INVENTOR(S) : Robert J. Lawton et al.

It is certified that error appears in the above-identified patent and that said Letters Patent is hereby corrected as shown below:

In the Claims

In column 10, line 8, in Claim 7, delete “unit.” and insert -- unit; --, therefor.

Signed and Sealed this
Seventeenth Day of June, 2014

Michelle K. Lee

Michelle K. Lee
*Deputy Director of the United States Patent and Trademark Office*